US009617046B1

(12) United States Patent
Sato

(10) Patent No.: US 9,617,046 B1
(45) Date of Patent: Apr. 11, 2017

(54) BEVERAGE LID APPARATUSES FOR DIRECTING SCENT TO A USER

(71) Applicant: Nathan Sato, Honolulu, HI (US)

(72) Inventor: Nathan Sato, Honolulu, HI (US)

( * ) Notice: Subject to any disclaimer, the term of this patent is extended or adjusted under 35 U.S.C. 154(b) by 0 days.

(21) Appl. No.: 14/879,879

(22) Filed: Oct. 9, 2015

(51) Int. Cl.

| | |
|---|---|
| ***B65D 51/18*** | (2006.01) |
| ***B65D 43/20*** | (2006.01) |
| ***B65D 43/06*** | (2006.01) |
| ***B65D 47/32*** | (2006.01) |
| *A47G 19/22* | (2006.01) |

(52) U.S. Cl.
CPC ..... *B65D 43/20* (2013.01); *B65D 43/06* (2013.01); *B65D 47/32* (2013.01); *B65D 51/18* (2013.01); *B65D 2251/009* (2013.01); *B65D 2251/0018* (2013.01); *B65D 2251/0028* (2013.01); *B65D 2251/0081* (2013.01); *B65D 2543/00046* (2013.01)

(58) Field of Classification Search
CPC ..... B65D 47/286; B65D 47/28; B65D 2543/00046; B65D 43/20; B65D 43/06; B65D 47/32; B65D 51/18; B65D 2251/0018; B65D 2251/0028; B65D 2251/0081; B65D 2251/009; A47G 19/2272
USPC .. 220/254.9, 259.5, 713, 714, 717, 718, 716
See application file for complete search history.

(56) References Cited

U.S. PATENT DOCUMENTS

| | | | | |
|---|---|---|---|---|
| 2,304,214 | A * | 12/1942 | Straub | B65D 47/286 220/254.9 |
| 4,570,817 | A * | 2/1986 | Hambleton | B65D 47/286 220/345.1 |
| 5,462,189 | A * | 10/1995 | Pierce | B65D 17/166 220/815 |
| 6,752,287 | B1 * | 6/2004 | Lin | A47G 19/2272 220/254.9 |
| 7,591,389 | B2 | 9/2009 | Wong | |
| 7,845,510 | B2 | 12/2010 | Schmidtner et al. | |
| 7,850,037 | B2 | 12/2010 | Schmidtner et al. | |
| 7,959,028 | B2 | 6/2011 | Leon | |
| D722,498 | S | 2/2015 | Fleming | |
| 8,950,623 | B2 | 2/2015 | Fleming | |
| 9,238,529 | B1 * | 1/2016 | Newman | B65D 43/12 |
| 2006/0201945 | A1 * | 9/2006 | Tedford, Jr. | B65D 47/286 220/254.9 |
| 2006/0261068 | A1 * | 11/2006 | Schmidtner | B65D 43/0208 220/254.9 |
| 2007/0278228 | A1 * | 12/2007 | Wong | B65D 47/286 220/254.9 |

(Continued)

*Primary Examiner* — J. Gregory Pickett
*Assistant Examiner* — Niki M Eloshway
(74) *Attorney, Agent, or Firm* — Bryne Poh LLP

(57) ABSTRACT

Beverage lid apparatuses for directing scent to a user are provided. In some embodiments, a beverage lid apparatus can be configured to attach to a beverage container and, by way of a drinking aperture on the lid, direct the scent of a beverage in the beverage container to the nose of a user when the user drinks from the drinking aperture. For example, the size and shape of the drinking aperture can be configured to allow scent from the beverage container to pass through the drinking aperture and above the flow of the beverage, upward into the nose of the user when the user drinks from the drinking aperture. In some embodiments, a beverage lid apparatus can further include a sliding cover configured to prevent spillage and/or contain heat and/or aroma.

6 Claims, 1 Drawing Sheet

(56) References Cited

U.S. PATENT DOCUMENTS

| | | | | |
|---|---|---|---|---|
| 2008/0073342 | A1* | 3/2008 | Cai | B65D 47/286<br>220/212 |
| 2008/0073343 | A1* | 3/2008 | Shadrach | B65D 47/286<br>220/212 |
| 2012/0012585 | A1* | 1/2012 | Sinacori | B65D 47/286<br>220/254.9 |
| 2014/0117016 | A1* | 5/2014 | Hodge | B65D 43/0212<br>220/254.9 |
| 2014/0305941 | A1 | 10/2014 | Hodge | |

* cited by examiner

BEVERAGE LID APPARATUSES FOR DIRECTING SCENT TO A USER

TECHNICAL FIELD

The disclosed subject matter relates to a beverage lid apparatuses that direct the scent of a beverage to a user.

BACKGROUND

Many beverages have scents that are pleasing to smell and significantly contribute to the flavor of the beverage. Frequently, these beverages are served hot, or consumed while travelling. As a result, it is increasingly popular to consume these beverages via a lidded beverage container. However, many of these lids limit the consumer's ability to smell their beverage while drinking it, limiting the consumer's enjoyment of the beverage.

Accordingly, it is desirable to provide new beverage lid apparatuses for directing the scent of a beverage to a user.

SUMMARY

Beverage lid apparatuses for directing scent to a user are provided. In accordance with some embodiments of the disclosed subject matter, beverage lid apparatuses for directing scent to a user are provided, the beverage lid apparatuses configured to cover a beverage container and comprising: a lid body comprising: a rim disposed along the edge of the lid body and shaped such as to allow the rim to make continuous contact with the beverage container; an upper surface having a drinking aperture; and a well wall disposed on the upper surface and protruding upward from the upper surface, wherein the well wall is positioned and shaped such as to surround at least a portion of the drinking aperture such that a user can drink a liquid passing through the drinking aperture by contacting a portion of the well wall with the mouth of the user, and wherein the drinking aperture is configured to direct scent originating from a beverage in the beverage container to the nose of the user upon the user positioning the beverage lid apparatus in proximity to the mouth of the user; and a sliding cover positioned within the perimeter of the well wall and attached to the lid body such as to allow a user to move the sliding cover from a first position to a second position, wherein the sliding cover blocks the drinking aperture when in the first position and allows a user to drink from the drinking aperture when in the second position.

In accordance with some embodiments of the disclosed subject matter, the drinking aperture is of a size and a shape such as to allow a user to add a substance to the beverage through the drinking aperture when the sliding cover is in the second position.

In accordance with some embodiments of the disclosed subject matter, the well wall has a height and shape such as to contain liquid escaping through the drinking aperture to the upper surface of the lid body.

In accordance with some embodiments of the disclosed subject matter, the lid body further comprises a ventilation hole positioned such that the ventilation hole is not covered by the sliding cover when the sliding cover is in the first position or in the second position.

In accordance with some embodiments of the disclosed subject matter, the well wall protrudes far enough upward from the upper surface such as to allow a user to drink a liquid passing through the drinking aperture by contacting a portion of the well wall with the mouth of the user while not making contact with the drinking aperture.

BRIEF DESCRIPTION OF THE DRAWINGS

Various objects, features, and advantages of the disclosed subject matter can be more fully appreciated with reference to the following detailed description of the disclosed subject matter when considered in connection with the following drawings, in which like reference numerals identify like elements.

DETAILED DESCRIPTION

Figure 1B:
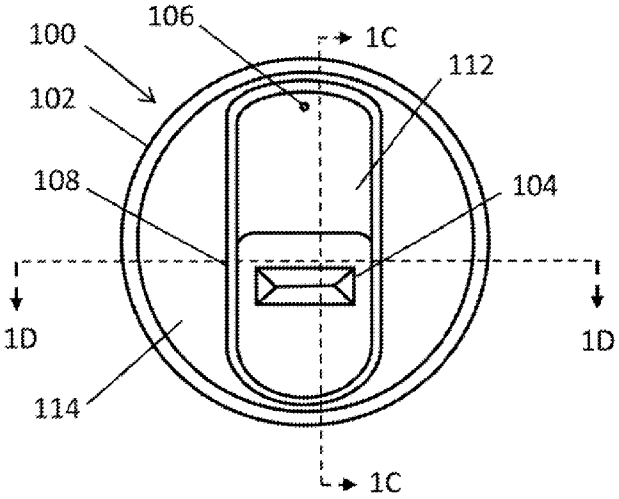
FIG. 1B shows a top view of an example of a beverage lid apparatus having a sliding cover that is in a closed position in accordance with some embodiments of the disclosed subject matter.

In accordance with various embodiments of the disclosed subject matter, beverage lid apparatuses that direct the scent of a beverage to a user are provided.

In some embodiments of the disclosed subject matter, a beverage lid apparatus can attach to a beverage container and, by way of a drinking aperture on the lid, direct the scent of a beverage in the beverage container to the nose of a user when the user drinks from the drinking aperture. For example, in some embodiments, a beverage lid apparatus can be attached to a coffee cup and upon a user bringing the beverage lid apparatus to his or her lips, the coffee can pass through the drinking aperture into the mouth of the user. Simultaneously, due to the size and shape of the drinking aperture, the scent from the coffee still contained in the coffee cup can pass through the drinking aperture, above the flow of coffee, and upward into the nose of the user.

In some embodiments, a beverage lid apparatus can include a sliding cover. The sliding cover can, for example, be moved from a closed position to an open position. When in the closed position, the sliding cover can block the drinking aperture, containing the liquid, scent, and/or heat of a beverage in the beverage container. When in the open position, the sliding cover can allow a user to drink and/or smell a beverage from the drinking aperture.

In some embodiments, the beverage lid apparatus can include a well wall that can contain liquid that comes up through the drinking aperture or through a ventilation hole when the user is not drinking, and prevent that liquid from spilling. For example, to continue the scenario of a coffee cup described above, a portion of coffee can escape through a ventilation hole of the beverage lid apparatus (e.g., when a user travels with the coffee cup) and rather than spilling onto the user, can be contained within the confines of the well wall.

Turning to FIGS. 1A, 1B, 1C, and 1D, an example 100 of a beverage lid apparatus that directs the scent of a beverage to a user in accordance with some embodiments of the disclosed subject matter is shown. As illustrated, in some embodiments, beverage lid apparatus 100 can include a rim 102, a sliding cover 104, a ventilation hole 106, a well wall 108, a drinking aperture 110, a well area 112, and an upper surface 114.

In some embodiments, any of the elements of beverage lid apparatus 100 can be made from any suitable material. For example, beverage lid apparatus 100 can be made from plastic, aluminum, ceramics, any other suitable material, and/or a combination thereof.

Rim 102 can be any suitable rim. In some embodiments, rim 102 can be configured to allow a user to attach beverage lid apparatus 100 to a beverage container by placing rim 102 in continuous contact with a beverage container and applying pressure to rim 102 in order to fit or snap into place.

Figure 1D:
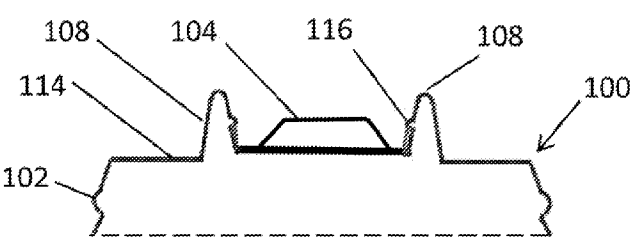
FIG. 1D shows another cross-sectional view of the cross-section 1D-1D shown in FIG. 1B of an example of a beverage lid apparatus in accordance with some embodiments of the disclosed subject matter.
Figure 1A:
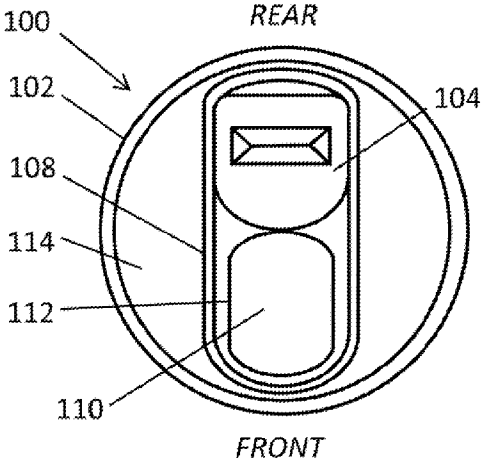
FIG. 1A shows a top view of an example of a beverage lid apparatus having a sliding cover that is in an open position in accordance with some embodiments of the disclosed subject matter.

Sliding cover 104 can be any suitable sliding cover. In some embodiments, sliding cover 104 can be attached to the beverage lid apparatus such that a user can move the sliding cover from a position that blocks drinking aperture 110 (a "closed position") to a position that does not block drinking aperture 110 (an "open position"), and/or to any position in between (e.g., a "partially open position"). For example, as shown in FIGS. 1A and 1B, sliding cover 104 can be configured to have straight or substantially straight sides and a width appropriate to fit between the sides of well wall 108 such that sliding cover 104 can slide between the sides of well wall 108, and/or move in any other suitable direction or fashion. In such an example, as illustrated in FIG. 1D, well wall 108 can have sides that are flat, parallel, substantially flat, substantially parallel, and/or any other suitable shape and configuration. To continue the example, slide track 116, as also shown in FIG. 1D, can be configured to guide sliding cover 104 between an open position and a closed position.

In some embodiments, sliding cover 104, well wall 108, drinking aperture 110, and slide track 116 can be configured to allow a user to move sliding cover 104 in a partially open position that prevents spillage. For example, a partially open position can block a portion of drinking aperture 110 that is large enough to allow the user to drink from the drinking aperture, but not large enough to allow liquid to spill over the lips of the user.

Figure 1C:
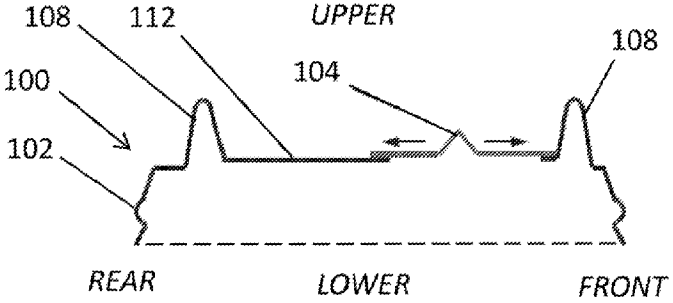
FIG. 1C shows a cross-sectional view of the cross-section 1C-1C shown in FIG. 1B of an example of a beverage lid apparatus having a sliding cover that is in a closed position in accordance with some embodiments of the disclosed subject matter.

In some embodiments, sliding cover 104, well wall 108, well area 112, and slide track 116 can be configured such that at least a portion of sliding cover 104 sits flatly upon well area 112, using any suitable configuration. For example, well area 112 can have a flat or substantially flat upper surface and sliding cover 104 can have a flat or substantially flat lower surface such that sliding cover 104 can rest flatly upon well area 112, as shown in FIGS. 1C and 1D. As another example, sliding cover 104 can have a concave lower surface and well area 112 can have a convex upper surface. As yet another example, sliding cover 104 and well area 112 can have a tongue and groove configuration with sliding cover 104 having one or more tongues that fit into one or more grooves in well area 112 and/or vice versa.

In some embodiments, sliding cover 104 can be configured to block drinking aperture 110 when in a closed position using any suitable configuration. For example, sliding cover 104 can have a size and shape large enough to cover drinking aperture 110 such as to block air, water, and/or other substances from escaping. As a more particular example, drinking aperture 110 can be one inch long and 0.5 inches wide while sliding cover 104 can be 1.1 inches long and 0.6 inches wide, and/or any other suitable dimensions. Additionally or alternatively, the lower surface of sliding cover 104 can have a contour that substantially matches the contour of well area 112 such that the lower surface of sliding cover 104 can sit flush with well area 112 at the edges of drinking aperture 110 such that there is no clearance between sliding cover 104 and well area 112 when sliding cover 104 is in the closed position.

In some embodiments, sliding cover 104 can have any suitable shape. For example, as shown in FIGS. 1A and 1B, sliding cover 104 can have edges that substantially match the shape of well wall 108 on one or more sides. As a more particular example, as shown in FIGS. 1A and 1B, sliding cover 104 can have a curved front edge such that sliding cover 104 can sit flush or substantially flush with a curved well wall 108.

In some embodiments, sliding cover 104 can be configured to hold its position relative to drinking aperture 110 such that sliding cover 104 will not move without a user applying force to the cover, using any suitable configuration. For example, sliding cover 104 can include a protrusion on its lower surface such that when sliding cover 104 is moved to a closed position, the protrusion will fit and/or snap into a depression in the upper surface of well area 112. As another example, sliding cover 104 can include a material associated with a relatively high coefficient of friction such that sliding cover 104 can slide less easily against well wall 108 and/or well area 112. As a more particular example, the lower surface of sliding cover 104 can be made from or coated with rubber, plastic, polystyrene, and/or any other material with a relatively high coefficient of friction. As yet another example, sliding cover 104 can include a protrusion on the front edge and/or the rear edge of its upper surface and/or its lower surface such that when sliding cover 104 is moved into an open position and/or a closed position, the protrusion can fit and/or snap into a depression in well wall 108.

In some embodiments, sliding cover 104, ventilation hole 106, and well wall 108 can be configured such that ventilation hole 106 remains unblocked or substantially unblocked by sliding cover 104 regardless of the position of sliding cover 104. For example, as shown in FIGS. 1A and 1B, sliding cover 104 can have a straight rear edge, well wall 108 can have a curved rear portion, and ventilation hole 106 can be located on well area 112 in the region between the straight rear edge of sliding cover 104 and the curved rear portion of well wall 108. In some embodiments, ventilation hole 106 can be blocked when sliding cover 104 is in an open position, and unblocked when sliding cover 104 is in another position.

In some embodiments, well wall 108 and well area 112 can be configured such that liquid escaping through ventilation hole 106 and/or drinking aperture 110 will be held in well area 112 and/or drain through drinking aperture 110 rather than spill onto a user using any suitable configuration. For example, well wall 108 can have a continuous shape that protrudes upward from the upper surface of beverage lid apparatus 100. As a more particular example, as shown in FIGS. 1A and 1B, well wall 108 can have a shape that is semi-circular in its front and rear portions and substantially straight in its sides.

In some embodiments, a portion of well wall 108 can protrude far enough upward such as to allow a user to drink a beverage from an attached beverage container by placing the user's mouth on the well wall without making contact with the drinking aperture. For example, well wall 108 can protrude far enough upward, at a portion of well wall 108 that is in proximity to drinking aperture 110, such that upon a user contacting the portion of well wall 108 with the mouth of the user and tilting the beverage container and beverage lid apparatus, the beverage will flow through drinking aperture 110 onto well wall 108 before making contact with the mouth of the user.

In some embodiments, drinking aperture 110 can be configured to direct the scent of a beverage into the nose of a user when the user positions the beverage lid apparatus, when attached to a beverage container containing the beverage, near the mouth of the user using any suitable configuration. For example, drinking aperture 110 can have a length (i.e., the length from the front rim of the aperture to the rear rim of the aperture) that is large enough to allow a portion of the drinking aperture to be uncovered when a user places his or her mouth against the aperture in order to drink the beverage. As another example, drinking aperture 110 can have a width that is large enough to allow the scent of the beverage, upon a user positioning the beverage lid apparatus in proximity to the mouth of the user, to pass through the drinking aperture and rise directly upward into one or both nostrils of the user's nose.

In some embodiments, upper surface 114 can extend above rim 102, relative to an attached beverage container, in order to create a cavity beneath beverage lid apparatus 100 and over the attached beverage container. For example, upper surface 114 can be high enough above rim 102 such as to allow a user to place a substantially solid substance and/or a substantially viscous substance (e.g., whipped cream) on top of a beverage in the beverage container while still allowing a user to attach beverage lid apparatus 100 to the beverage container.

In some embodiments, at least some of the above described parts of the beverage lid apparatus of FIGS. 1A-1D can be omitted.

Although the invention has been described and illustrated in the foregoing illustrative embodiments, it is understood that the present disclosure has been made only by way of example, and that numerous changes in the details of implementation of the invention can be made without departing from the spirit and scope of the invention, which is limited only by the claims that follow. Features of the disclosed embodiments can be combined and rearranged in various ways.

What is claimed is:

1. A beverage lid apparatus for covering a beverage container, the beverage lid apparatus comprising:

a lid body comprising:

a rim having an upper surface and disposed along the edge of the lid body and shaped such as to allow the rim to make continuous contact with the beverage container;

an upper surface having a drinking aperture, wherein the upper surface is substantially planar and located at the upper surface of the rim; and a well wall disposed on the upper surface, protruding upward from the upper surface, having a top portion that is higher than the upper surface of the rim, being separate from the rim, comprising two parallel sections, and including two protrusions, each of the two protrusions being on an interior side of a different one of the two parallel sections, wherein the well wall is positioned and shaped such as to surround at least a portion of the drinking aperture such that a user can drink a liquid passing through the drinking aperture by contacting a portion of the well wall with the mouth of the user, and wherein the drinking aperture is configured to direct scent originating from a beverage in the beverage container to the nose of the user upon the user positioning the beverage lid apparatus in proximity to the mouth of the user, and wherein the top portion of the well wall forms a highest surface of the lid body; and a sliding cover having a top surface and two parallel edges and positioned on the upper surface such as to allow a user to move the sliding cover from a first position to a second position, wherein the sliding cover blocks the drinking aperture when in the first position and allows a user to drink from the drinking aperture when in the second position, wherein each of the two parallel edges is positioned between a corresponding one of the two protrusions and the upper surface, wherein each of the two parallel edges maintains contact with the corresponding one of the two protrusions and the upper surface when moved from the first position to the second position, and wherein the top surface is below the top portion of the well wall.

2. The beverage lid apparatus of claim 1, wherein the drinking aperture is of a size and a shape such as to allow a user to add a substance to the beverage through the drinking aperture when the sliding cover is in the second position.

3. The beverage lid apparatus of claim 1, wherein the well wall has a height and a shape such as to contain liquid escaping through the drinking aperture to the upper surface of the lid body.

4. The beverage lid apparatus of claim 1, wherein the lid body further comprises a ventilation hole positioned such that the ventilation hole is not covered by the sliding cover when the sliding cover is in the first position or in the second position.

5. The beverage lid apparatus of claim 1, wherein the well wall protrudes far enough upward from the upper surface such as to allow a user to drink a liquid passing through the drinking aperture by contacting a portion of the well wall with the mouth of the user while not making contact with the drinking aperture.

6. The beverage lid apparatus of claim 1, wherein the lid body further comprises a ventilation hole positioned such that the ventilation hole is not covered by the sliding cover when the sliding cover is in the first position and the ventilation hole is covered by the sliding cover when the sliding cover is in the second position.

* * * * *